United States Patent [19]

Nelson

[11] 3,977,119

[45] Aug. 31, 1976

[54] COLLAPSIBLE PLAYHOUSE MADE OF TWO EQUAL PARTS

[76] Inventor: Donald Carl Nelson, 312 Belmont Ave., Mount Pocono, Pa. 18344

[22] Filed: June 26, 1975

[21] Appl. No.: 590,481

[52] U.S. Cl. ..... 46/12

[51] Int. Cl.[2] ..... A63B 33/00

[58] Field of Search ..... 46/12, 21, 11, 13

[56] References Cited

UNITED STATES PATENTS

| | | | |
|---|---|---|---|
| 1,867,374 | 7/1932 | Myers | 46/21 |
| 2,083,597 | 6/1937 | Edelman | 46/11 |
| 3,456,380 | 7/1969 | Cameron | 46/12 |
| 3,719,001 | 3/1973 | Archer | 46/21 X |

FOREIGN PATENTS OR APPLICATIONS

| | | | |
|---|---|---|---|
| 289,615 | 5/1928 | United Kingdom | 46/21 |
| 588,518 | 5/1947 | United Kingdom | 46/21 |

*Primary Examiner*—F. Barry Shay

[57] ABSTRACT

A simple collapsible playhouse of substantial dimensions made of rigid material which can be easily folded for storage or easily opened for use by anyone including small children. The playhouse can be made of two equal parts which when properly taped or hinged together form a complete playhouse.

1 Claim, 4 Drawing Figures

INVENTOR
Donald C. Nelson

COLLAPSIBLE PLAYHOUSE MADE OF TWO EQUAL PARTS

This invention relates to a simple structure capable of being erected into a playhouse of substantial dimensions and the ease with which to fold said structure into a compact package for storage purposes.

One objective of this invention is to provide an article which is generally improved and more satisfactory than similar articles heretofore known.

The second objective is to provide a structure which is light and easy to handle and which can be simply erected or folded for storage purposes by anyone including small children.

The certain improvements and advantages of this invention will be more fully pointed out in the claim at the end of this specification.

Figure 1:
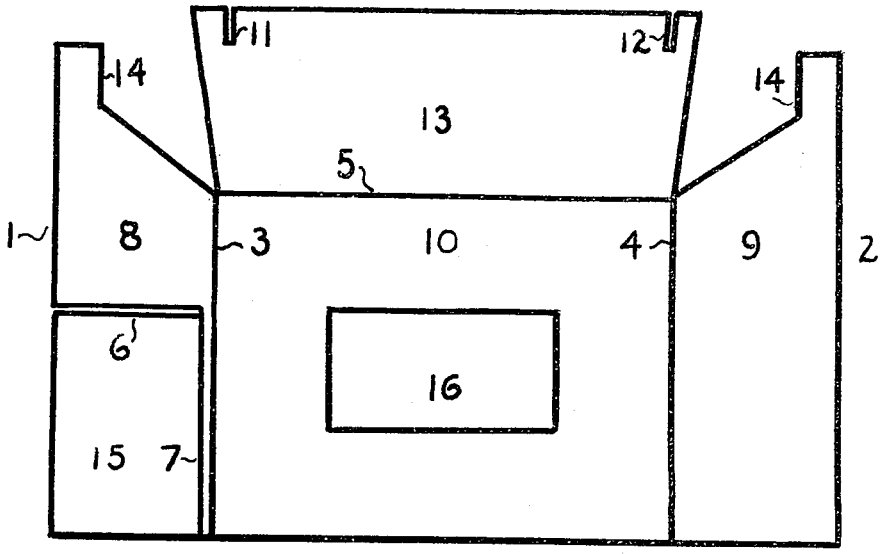
FIG. 1 is a plan view of a pattern from which my improved playhouse can be formed. Each pattern consists of one half of the playhouse.

All parts are identified by their numerals of reference which are the same in each of the views.

The playhouse can be composed of two equal parts, which when properly folded and taped or hinged together along line 1–2, form a complete playhouse. Scored lines 3 and 4 are folded 90° to form one half the end walls marked 8 and 9 plus one side wall marked 10. scored line 5 is folded inward until the slots 11 and 12 in half roof 13 fit around the chimney 14 to form a rigid structure. Cut line 6 and scored line 7 allow the door 15 to open or close or line 7 can be cut through and the door 15 omitted entirely. The window opening 16 may be of any convenient size or more than one window may be provided.

Figure 3:
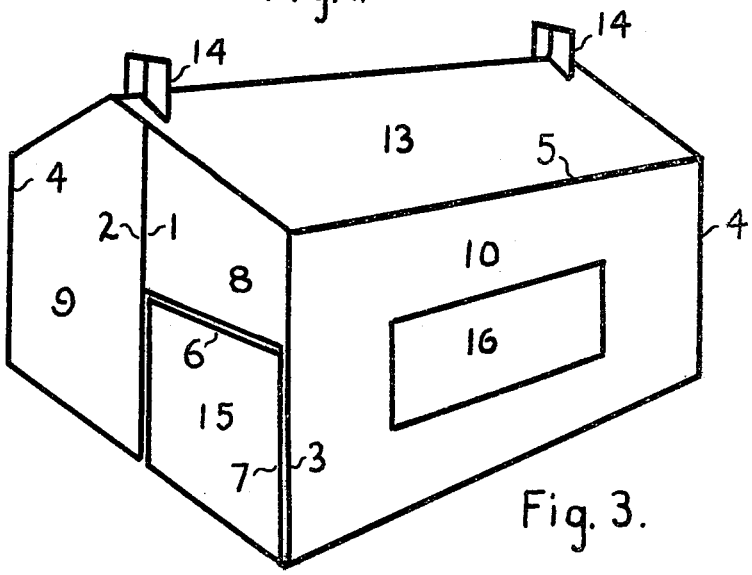
FIG. 3 shows a perspective view of the playhouse in a fully erected position.
Figure 4:
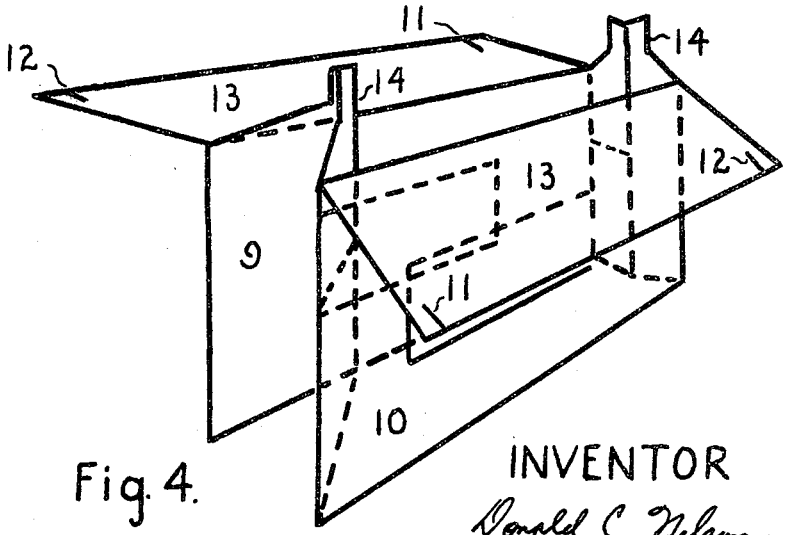
FIG. 4 shows the playhouse in a partially folded position.

As can be seen in FIG. 1, side wall 10 is a rectangle bounded by parallel fold lines 3, 4 and fold line 5, perpendicular to lines 3 and 4. The half end walls have parallel vertical sides and upwardly inclined upper edges. The half roof has a free edge longer than fold line 5 and arranged so that slots 11, 12, near the free edge ends, can receive projections 14 as shown in FIG. 3.

Figure 2:
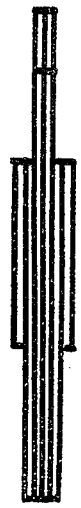
FIG. 2 shows an end view of the playhouse completely folded for storage.

Referring now to FIG. 1. The collapsible playhouse constructed according to my invention consists of, when made of cardboard or similar material, two or more pieces which when properly folded and taped or hinged form a complete playhouse. If materials used make scoring impractical, all scored areas can be cut through and hinged instead so the playhouse can be folded flat for easy storage as shown in FIG. 2.

I claim as my invention:

1. A simple collapsible playhouse:

made of two equal parts, each said part comprising one rectangular side wall, two half end walls connected by fold lines at respective ends of said side wall and a half roof connected by a fold line to the upper longitudinal edge of said sidewall, each said half end wall having a bottom edge perpendicular to its associated fold line, an end edge substantially parallel to but longer than said associated fold line and a straight upper edge portion inclined upwardly from said associated fold line, said upper edge portion terminating in a short rectangular projection parallel to said end edge, said half roof having a free edge parallel to and longer than its associated fold line, and having a slot at each end extending perpendicularly to said free edge; means permanently connecting both the end edges of said half end walls to one another so that the playhouse may be moved from a collapsed position, wherein the end walls are folded between the side walls, to an erected position wherein the end walls are perpendicular to said side walls and said half roofs overlie said end wall upper edges with the projections on said end walls received in said slots.

* * * * *